US007806149B2

(12) United States Patent
Borer

(10) Patent No.: US 7,806,149 B2
(45) Date of Patent: Oct. 5, 2010

(54) SHEDDING APPARATUS FOR A WEAVING MACHINE, IN PARTICULAR FOR A RIBBON WEAVING MACHINE

(75) Inventor: Silvan Borer, Frick (CH)

(73) Assignee: Textilma AG, Standsstad (CH)

( * ) Notice: Subject to any disclaimer, the term of this patent is extended or adjusted under 35 U.S.C. 154(b) by 0 days.

(21) Appl. No.: 12/311,389

(22) PCT Filed: Sep. 27, 2007

(86) PCT No.: PCT/CH2007/000475

§ 371 (c)(1),
(2), (4) Date: Apr. 20, 2009

(87) PCT Pub. No.: WO2008/037106

PCT Pub. Date: Apr. 3, 2008

(65) Prior Publication Data

US 2009/0277529 A1 Nov. 12, 2009

(30) Foreign Application Priority Data

Sep. 28, 2006 (CH) ..... 1550/06

(51) Int. Cl.
*D03C 3/20* (2006.01)
*D03C 3/40* (2006.01)
*D03C 3/42* (2006.01)
*D03C 13/00* (2006.01)

(52) U.S. Cl. ..... 139/455; 139/55.1; 139/82; 139/91

(58) Field of Classification Search ..... 139/55.1, 139/82–91, 455
See application file for complete search history.

(56) References Cited

U.S. PATENT DOCUMENTS

| | | | | | |
|---|---|---|---|---|---|
| 3,643,384 | A * | 2/1972 | Isaacson et al. | ..... | 451/326 |
| 3,766,399 | A * | 10/1973 | Demetrescu | ..... | 290/40 R |
| 4,572,247 | A * | 2/1986 | Speich | ..... | 139/455 |
| 4,577,665 | A * | 3/1986 | Diesner | ..... | 139/431 |
| 5,070,913 | A * | 12/1991 | Palmer | ..... | 139/319 |
| 5,201,199 | A * | 4/1993 | Kemper | ..... | 66/204 |
| 5,373,871 | A * | 12/1994 | Speich | ..... | 139/455 |
| 6,079,455 | A * | 6/2000 | Speich et al. | ..... | 139/455 |
| 6,478,055 | B1 * | 11/2002 | Dewispelaere | ..... | 139/455 |

(Continued)

FOREIGN PATENT DOCUMENTS

DE 296 21 008 U1 1/1997

(Continued)

*Primary Examiner*—Bobby H Muromoto, Jr.
(74) *Attorney, Agent, or Firm*—George Pappas

(57) ABSTRACT

In order to make a small space requirement, a low energy requirement and therefore an increased weaving frequency possible in a shedding apparatus, a spring drive is proposed which is connected to magnetically acting holding means. The holding means are capable of holding the heddle frame in an upper shed position and in a lower shed position counter to the spring force. Furthermore, the heddle frame is connected to a linear motor. A heddle movement can be initiated by said linear motor. According to the invention, the spring drive is configured as a tension/compression spring which is designed in such a way that, during operation of the heddle frame at the resonant frequency of the spring drive the greater part of the kinetic energy can be obtained from the spring drive.

20 Claims, 5 Drawing Sheets

U.S. PATENT DOCUMENTS

| | | | | |
|---|---|---|---|---|
| 7,057,329 | B2 * | 6/2006 | Barth et al. | 310/323.17 |
| 7,059,356 | B2 * | 6/2006 | Mettler | 139/55.1 |
| 2002/0046778 | A1 * | 4/2002 | Dewispelaere | 139/455 |
| 2003/0019534 | A1 * | 1/2003 | Verdiere et al. | 139/55.1 |
| 2005/0056334 | A1 * | 3/2005 | Bruske et al. | 139/91 |
| 2005/0194055 | A1 * | 9/2005 | Volpi et al. | 139/55.1 |
| 2005/0204834 | A1 * | 9/2005 | Speich et al. | 74/25 |

FOREIGN PATENT DOCUMENTS

| | | | |
|---|---|---|---|
| JP | 09/170133 | A | 6/1997 |
| WO | WO 98/24955 | | 6/1998 |
| WO | WO 2005/010257 | A1 | 2/2005 |

* cited by examiner

SHEDDING APPARATUS FOR A WEAVING MACHINE, IN PARTICULAR FOR A RIBBON WEAVING MACHINE

This application claims priority of PCT application PCT/CH2007/000475 having a priority date of Sep. 28, 2006, the disclosure of which is incorporated herein by reference.

TECHNICAL FIELD

The invention relates to a shedding apparatus for a weaving machine, in particular for a ribbon weaving machine.

BACKGROUND OF THE INVENTION

Shedding apparatuses for weaving machines which have a heddle apparatus and a heddle frame are known in principle from numerous documents. WO-A-98/24955 discloses a weaving machine in which the dragging element for dragging the warp threads of a weaving machine and comprising for example a heddle frame is clamped between two springs. There, the dragging element oscillates and a holding device is capable of stopping the oscillation for a certain time, and so forming a shed during the weft insertion. The holding device from WO-A-98/24955 is intended to be controllable by means of a control unit. Permanent magnets which can be influenced by electromagnets have already been proposed for this.

However, the configuration with the two springs of WO-A-98/24955 takes up a relatively large space, as the drawings there also show. Furthermore, the controlled holding device is complicated, even if it takes the form of permanent magnets, because of the electromagnetic influence on the permanent magnets.

SUMMARY OF THE INVENTION

The object of the invention is to improve a shedding apparatus for weaving machines which have a heddle apparatus and a heddle frame.

The object is achieved by a shedding apparatus. In this case, the measures of the invention firstly result in a very small space requirement. The kinetic energy of the heddle motion can be provided for the most part by a tension/compression spring. The tension/compression spring is in this case set up in such a way that, in an upper position and in a lower position, it respectively provides a great potential energy as a force which moves the heddle in the direction of a middle position. The middle position is preferably characterized in that, in this position, no potential energy is emitted by the spring, but instead the heddle has a maximum speed, and is then moved further into the other position respectively, that is to say the lower position or the upper position, the tension/compression spring then being able to take up the kinetic energy of the heddle in the form of potential energy. In order, however, to make a controlled heddle motion possible, and optional pausing in the upper position or lower position, magnetically acting holding means are respectively provided in the upper position and the lower position, means which stop the heddle motion and hold the heddle in the respective position. In order to make a controlled motion possible, an optionally switchable, electric linear motor is additionally provided. Together with the spring force, it overcomes the holding force of the holding means and can therefore free the heddle from its held position. In principle, the linear motor is therefore intended for releasing the heddle from the holding means and initiating the heddle moving operation. Furthermore, the linear drive means serves the purpose of compensating for energy losses and adapting the heddle apparatus to changing operating conditions. The heddle apparatus is controlled exclusively by the control of the linear motor.

It is advantageous if at least 75% of the kinetic energy is taken from the tension/compression spring, and the linear motor provides at most 25% of the kinetic energy.

An advantageous refinement of the invention is obtained if the holding means are formed in an uncontrolled manner as permanent magnets which interact with magnetic counter-holders.

A form is particularly advantageous, since the entry of the magnetically acting holding elements, which are advantageously formed from iron, into the effective range of the coil magnets avoids direct contact, resulting in particularly low-noise running of the shedding apparatus.

Advantageously, no force is exerted on the heddle frame in a third shed position, between the upper shed position and the lower shed position.

It is particularly advantageous with respect to the allocation of space and the dynamic properties of the system if the tension/compression spring is formed as a leaf spring, and thereby formed in an ring-like manner. It goes without saying that in this context a ring does not have to be interpreted as a circular formation. Rather, the term "ring-like" is to be understood as meaning closed formations such as round, oval, elliptical or similarly formed springs, which are possibly suitable for accommodating components within them for the purpose of reducing the space requirement. In one particular embodiment, it is provided that the spring force to be applied is divided between two springs, which are arranged at the ends of the heddle apparatus. In order to eliminate the transverse forces, it is advantageous if the heddle apparatus is formed symmetrically with respect to its center axis.

An advantageous shedding apparatus has a number of heddle apparatuses arranged in a group. It is particularly advantageous in this respect if the tension/compression springs are arranged alternating with one another, one or more on top and one or more underneath.

In the case of the embodiment with stop magnets and magnetic counter-holders, it is more advantageous if they heddle apparatus has a support frame that is connected to the heddle frame and encloses a fixed block part. In this case, the stop magnets and the magnetic counter-holders are arranged on the upper and lower parts of the support frame or on the upper side and underside of the block part, respectively. If the block part then has a respectively adjustable upper part and lower part, these can be adjusted according to the inclination of the running of the warp threads of the upper shed and the lower shed, respectively.

It is advantageous if the linear motor has a flat coil, which is arranged in the plane of the heddle frame.

The aforementioned elements to be used according to the invention, as well as those claimed and described in the following exemplary embodiments, are not subject to any particular conditions by way of exclusion in terms of their size, shape, use of material and technical design, with the result that the selection criteria known in the respective field of application can be used unrestrictedly.

BRIEF DESCRIPTION OF THE DRAWINGS

Exemplary embodiments of a shedding apparatus for weaving machines with a heddle apparatus and a heddle frame are described in more detail below on the basis of the drawings, in which.

DETAILED DESCRIPTION OF THE PREFERRED EMBODIMENTS

Figure 1:
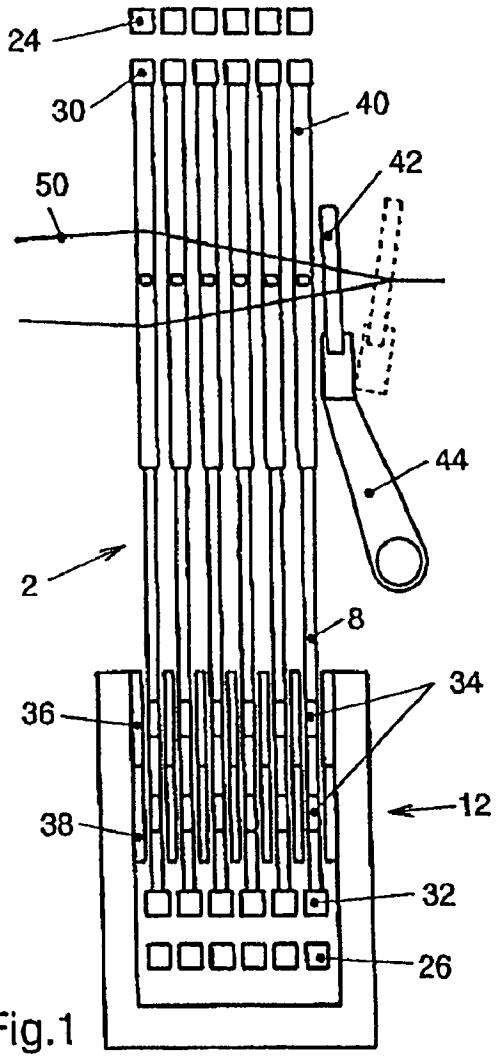
FIG. 1 shows the weaving region of a weaving machine with a shedding apparatus according to a first embodiment of the present invention, in side view.
Figure 2:
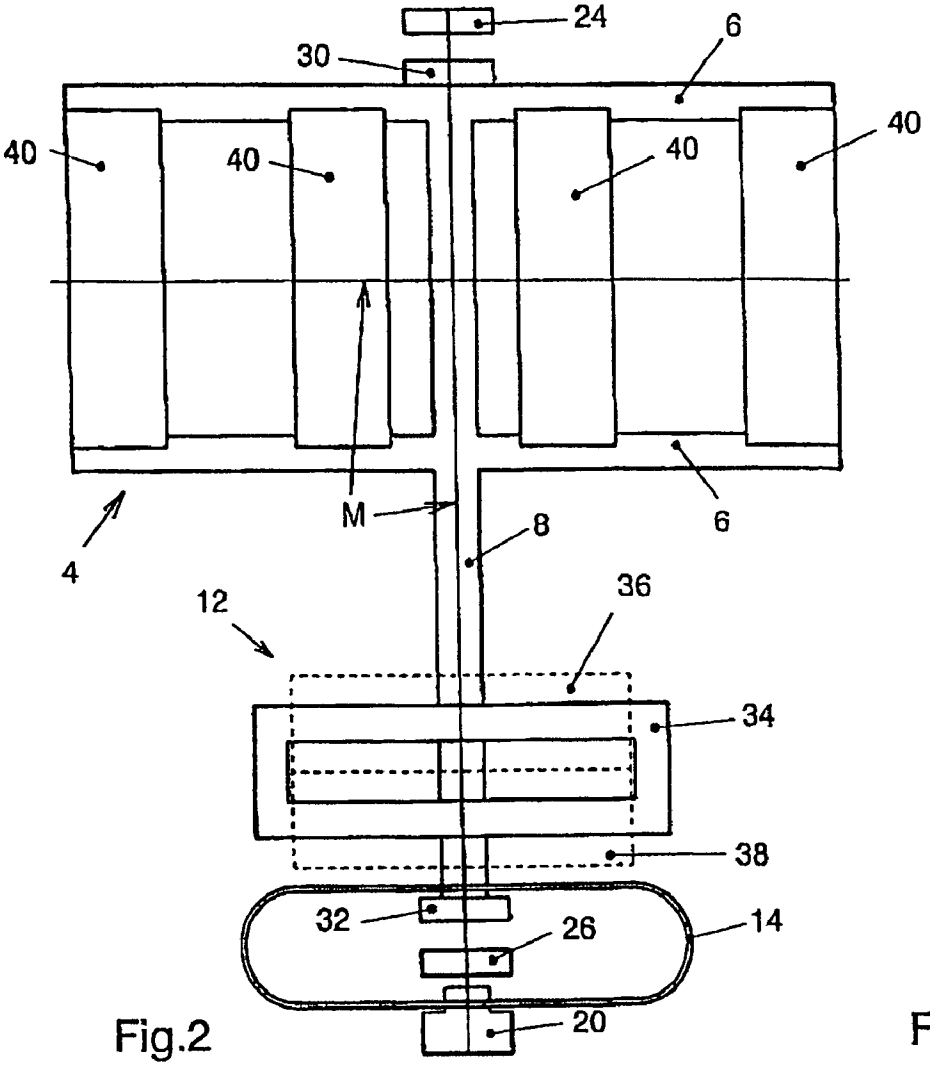
FIG. 2 shows a single heddle apparatus of the shedding apparatus from FIG. 1 in a view from the front.

A first exemplary embodiment for carrying out the present invention is represented in FIGS. 1 and 2.

FIG. 1 shows the diagram of the weaving region of a weaving machine in side view. A shedding apparatus with a number of heddle apparatuses 2 serves the purpose of opening warp threads 50 to form a weaving shed with an upper shed and a lower shed, into which a weft insertion element inserts a weft thread with every change of shed. A weaving reed 42 beats up the inserted weft thread at the edge of the fabric produced.

As FIG. 2 reveals, each heddle apparatus 2 includes a heddle frame 4, with heddle supports 6, on which heddles 40 for guiding the warp threads 50 are arranged. In the present example, the heddles 40 are grouped together in four groups for four weaving locations of a ribbon weaving machine. The heddle frame 4 is connected to a linear motor 12 by way of a heddle connector 8. In FIG. 1, the heddle apparatus 2 has at the top and bottom and upper, fixed stop magnet 24 and a lower, fixed stop magnet 26, which in the state in which they are brought into close proximity, interact with the respective magnetic counter-holders 30 and 32, which are assigned to the moved heddle frame 4.

In FIG. 2, the heddle apparatus 2 is represented from the front. Shown in FIG. 2 as an addition to the representation in FIG. 1 is a leaf spring 14, which is formed in a ring-like manner and assists a heddle motion in the vertical direction. One particular feature of this exemplary embodiment is that here the lower stop magnet 26 is accommodated within the leaf spring 14 and the corresponding lower magnetic counter-holder 32 is mounted on the leaf spring 14. The stop magnet 24 is mounted on the spring holder 20, which holds the leaf spring. In this exemplary embodiment, the upper magnetic counter-holder 30 is attached to the heddle frame 4, while the upper stop magnet 24 is fixedly mounted.

The heddle apparatus is formed symmetrically with respect to a center line M, in order to avoid transverse forces.

The operating mode of the shedding apparatus is now described below, according to the exemplary embodiment described above. The heddle frames 4 with the heddle supports 6 are raised and lowered for the purpose of shedding. As the driving means for this movement, the spring drive, in the exemplary embodiment the leaf spring 14 arranged on the spring holder 20, and a linear motor 12 interact. The linear motor 12 comprises a flat coil 34 and an upper coil magnet 36 and a lower coil magnet 38, which are arranged on the heddle connector 8. During the lifting or lowering movement, the greatest proportion of energy is applied by the spring drive. However, the movement is initiated by the linear motor 12, as described below.

By means of the upper stop magnet 24 or the lower stop magnet 26 and the respective magnetic counter-holders 30 and 32, the heddle frame 4 is securely held in the upper end position or the lower end position—which correspond to the upper shed position and the lower shed position of the warp threads of a weaving shed—as long as the linear motor 12 is not in operation. This is achieved by the stop magnets 24 and 26, which are formed as permanent magnets, having a greater holding force than the restoring force of the leaf spring 14 in the case of the deflection to the end positions. It should be pointed out that the holding force of the permanent magnets 24 and 26 has a short range and is therefore only relevant at all in the vicinity of the magnetic counter-holders 30 and 32, and consequently only in or in the vicinity of the respective end position.

In order then to set the heddle frame 4 in motion, in order therefore to initiate a shedding motion from the upper end position into the lower end position or from the lower end position into the upper end position, the linear motor 12 is put into operation. The sum of the effective forces of the linear motor 12 and the spring force of the leaf spring 14 in the deflected state, that is to say in one of the end positions, is greater than the holding force of the permanent magnets 24 and 26, respectively.

When the holding force of the permanent magnets 24 and 26 is overcome, the motion of the heddle is brought about for the most part by the spring force of the leaf spring 14, and the linear motor 12 moves along with this motion without significantly contributing to it. When the other end position is reached, that is to say for example when the lower stop magnet 26 enters the effective range of the lower magnetic counter-holder 32, the renewed end position is reached and the leaf spring 14 remains deflected, since the force of the permanent magnet 26 in this position is greater than the restoring force of the leaf spring 14, and the linear motor 12 does not assist the latter.

Figure 3:
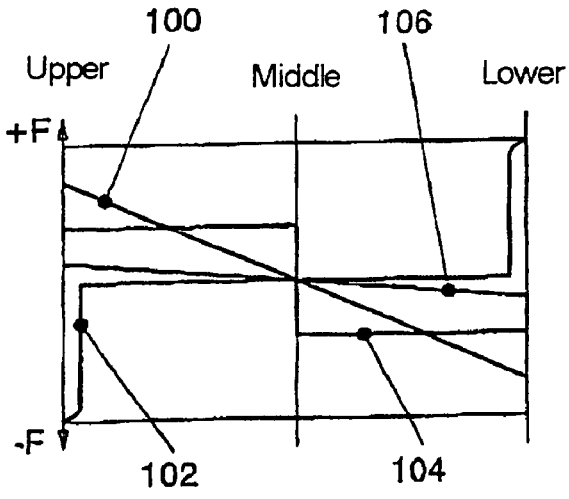
FIG. 3 shows a force diagram for the sequences of movements of the heddle motion of the apparatus according to FIGS. 1 and 2.

The force profile of the motion is shown in the diagram of forces in FIG. 3. In the exemplary embodiment mentioned here, the ring-like leaf spring 14 is operated in the linear range, so that the spring force diagram 100 can be represented by a straight line. The spring force is assisted by the warp thread force 106 only insignificantly, so that the warp thread force 106 plays no part here. The stop magnet diagram 102 clearly shows the short range of the magnetic forces, which only act when the stop magnets 24, 26 are in the direct vicinity of the magnetic counter-holders 30, 32 and an end position has been assumed. The diagram of coil forces 104 of the linear motor 12 has a constant force in the operating mode described here, which may be directed in one direction or the other, depending on polarity.

In the exemplary embodiments described here, the linear motor 12 is formed in such a way that, in addition to the upper position and the lower position, a middle position of the heddle can be assumed, and the heddle can be moved from this middle position into the upper position or into the lower position.

This operating mode has the purpose that a rest position can be assumed, a position in which the leaf spring 14 does not exert any force on the heddle frame. The heddle apparatus is controlled exclusively by means of the linear motor, which for this purpose is connected to a control unit of a weaving machine in a way that is not represented in any more detail.

Figure 4:
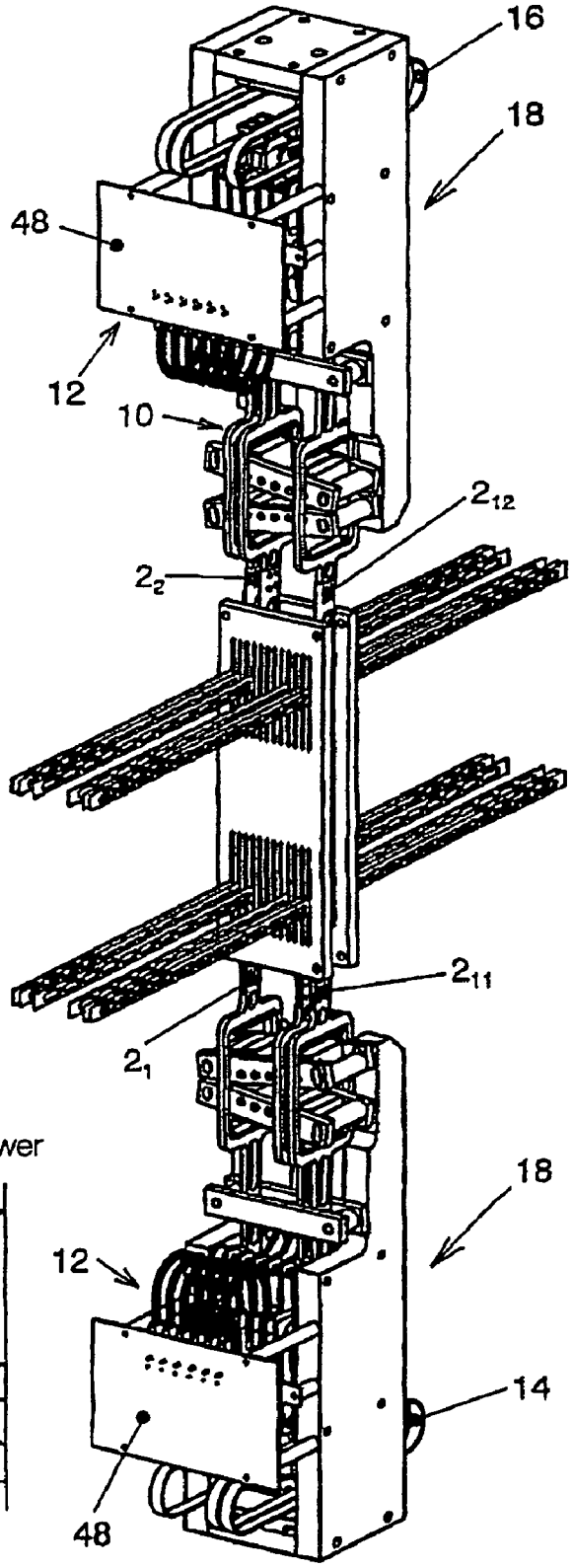
FIG. 4 shows a shedding apparatus with a heddle apparatus according to an alternative embodiment of the present invention in a perspective view.
Figure 5:
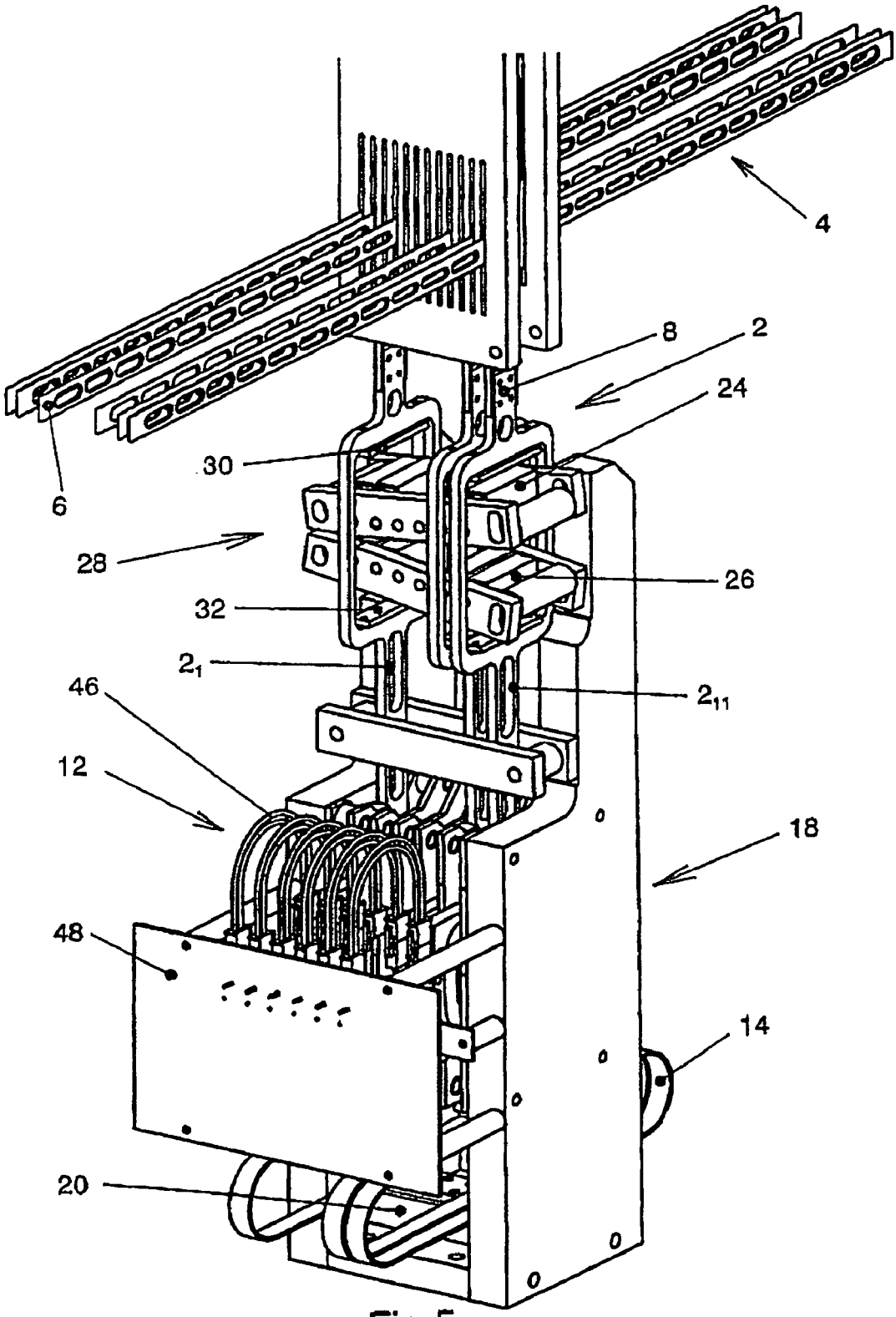
FIG. 5 shows an enlarged representation of a detail from FIG. 4.

FIG. 4 and FIG. 5 show a shedding apparatus according to a second exemplary embodiment, comprising a multiplicity of heddle apparatuses $2_1$-$2_6$ with in each case a heddle frame 4 according to a preferred exemplary embodiment. Of the heddle frames 4, only the heddle supports 6 are represented here. In the embodiment that is shown in FIGS. 4 and 5, the heddle frames 4 are connected at the top or bottom by means of a heddle connector 8 to a support frame 10, which for its part is connected to a linear motor 12 and then further connected to a leaf spring 14 or 16 formed in a ring-like manner. The lower leaf springs 14 are attached to a lower, fixed shedding block 18 with a spring holder 20, whereas the upper leaf springs 16 are attached to an upper, fixed shedding block 22, likewise with a spring holder 20. The leaf springs 14 and 16 act in turn as tension/compression springs and the spring arrangement and adjustment is chosen such that the heddle frames 4 are in the middle shed position in the rest position of the springs 14, 16.

In the support frames 10, the magnetic counter-holders 30 and 32 are respectively attached from the inside at the top and bottom. The lower shedding block 18 and the upper shedding block 22 respectively have at the upper and lower ends a block part 28, to which stop magnets 24 and 26 are attached. In the present exemplary embodiment, the stop magnets 24 and 26 are arranged in an inclined plane. In this respect, the inclinations are adjustable according to the desired inclination of the running of the warp thread of the upper shed and the lower shed, respectively.

The linear motors 12 have in each case electrical conductors 46, which are led to a connection plate 48, by way of which the linear motors 12 can be connected to a control unit.

Figure 6:
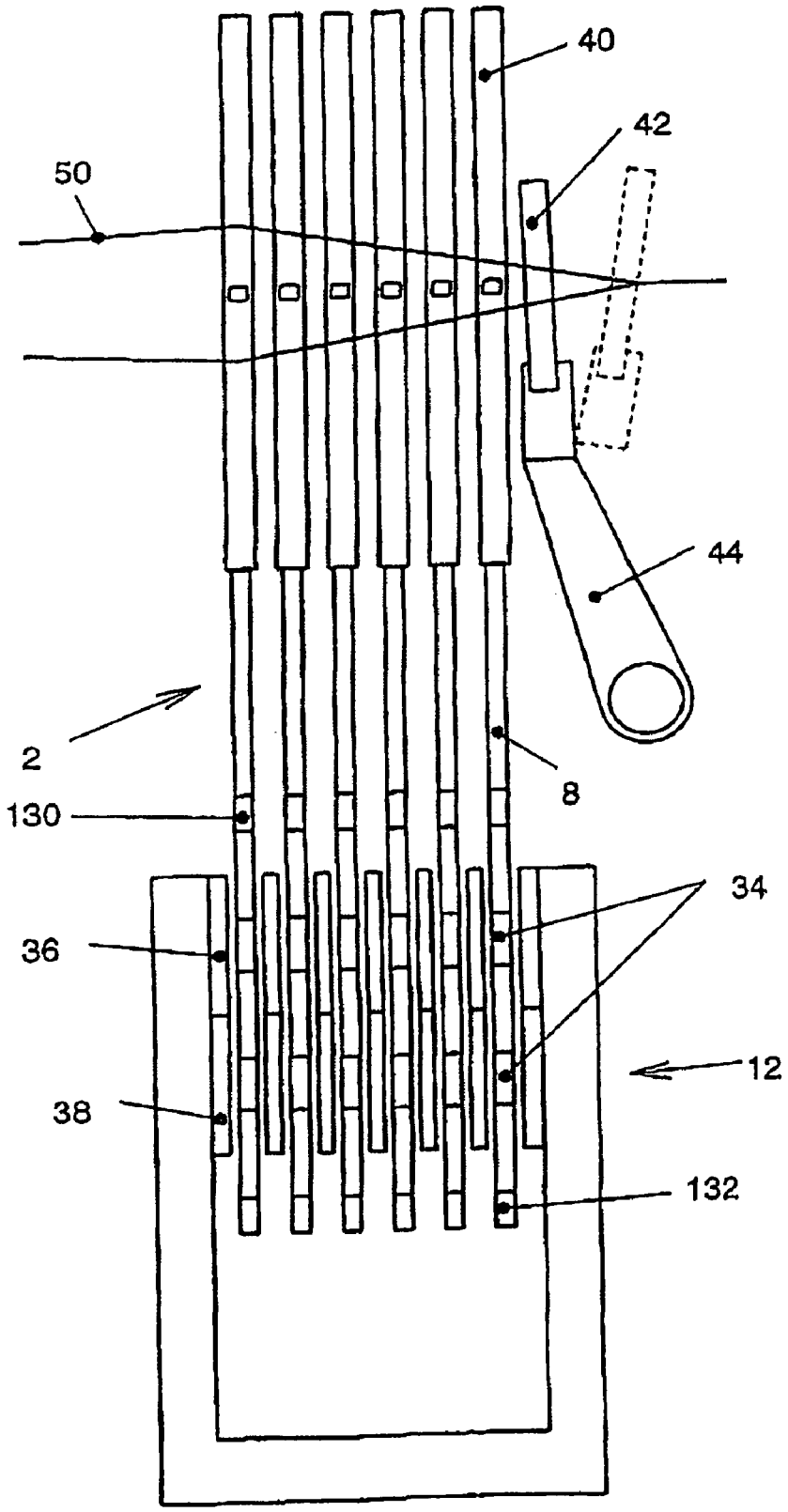
FIG. 6 shows the weaving region of a weaving machine with a shedding apparatus according to a further embodiment of the present invention, in side view.
Figure 7:
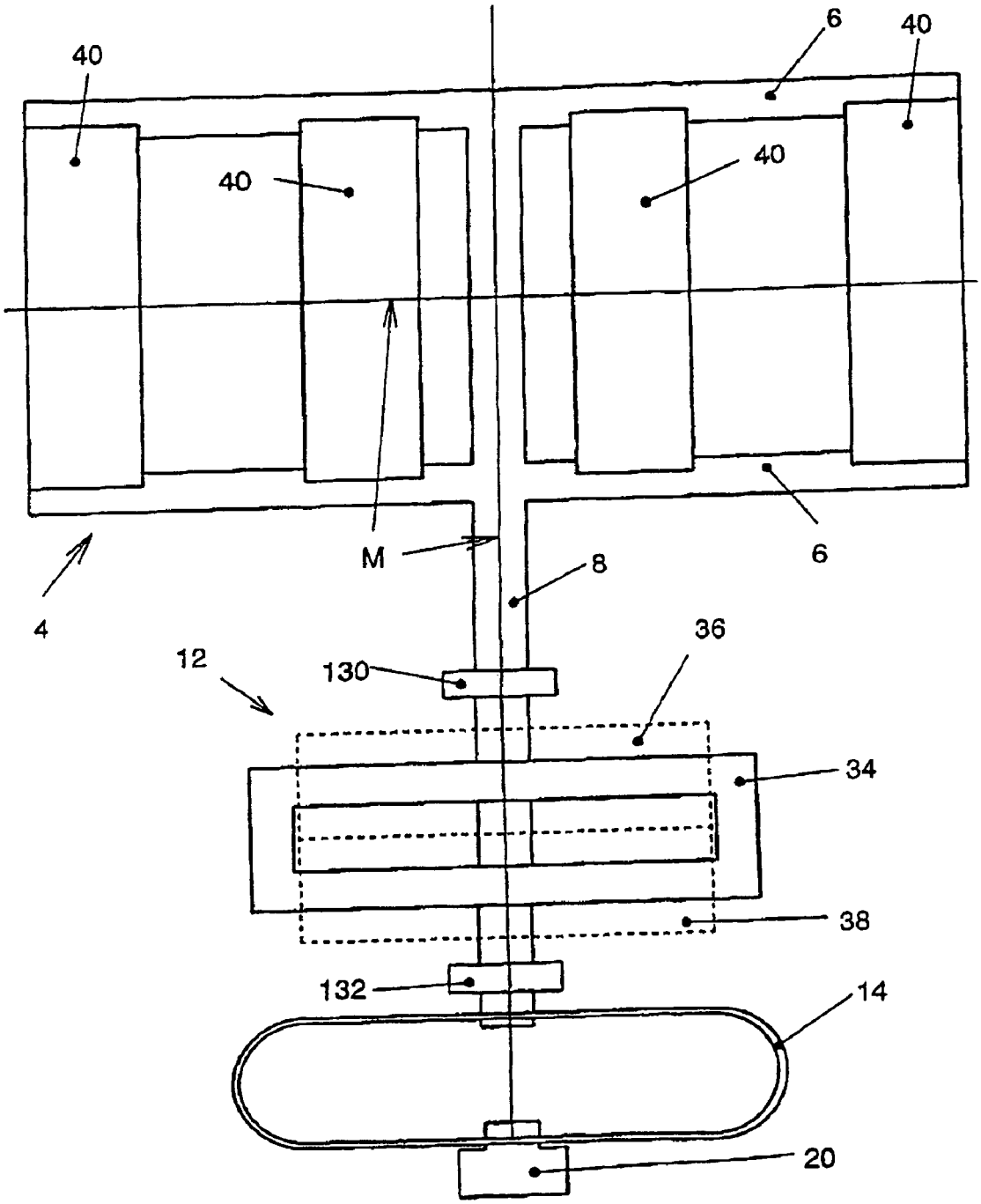
FIG. 7 shows a single heddle apparatus of the shedding apparatus from FIG. 6 in a view from the front.

A further exemplary embodiment for carrying out the present invention is represented in FIGS. 6 and 7.

FIG. 6 shows the diagram of the weaving region of such a weaving machine according to a further exemplary embodiment in side view. The shedding apparatus with the heddle apparatuses 2 corresponds to the first exemplary embodiment and is not described any further here.

In FIG. 6, the heddle apparatus 2 respectively has above and below the flat coil 34 of the linear motor 12 an upper and lower magnetically acting holding element 130, 132—in the exemplary embodiment made of iron—which alternately enter the magnetic field of the coil magnets 26 and 38 and form with them upper and lower holding means 130, 36; 132, 38.

The heddle apparatus is in turn formed symmetrically with respect to a center line M, in order to avoid transverse forces.

By means of the upper holding means 130, 36 or the lower holding means 132, 38, the heddle frame 4 is in turn securely held in the upper end position or the lower end position—which correspond to the upper shed position and the lower shed position of the warp threads of a weaving shed—as long as the linear motor 12 is not in operation. This is achieved by the holding means having a greater holding force than the restoring force of the leaf spring 14 in the case of the deflection to the end positions. It should be pointed out that the holding force of the holding means has a short range and is therefore only relevant at all in the state in which it has entered the range of the counter-element, and consequently only in or in the region of the respective end position.

In order then to set the heddle frame 4 in motion, in order therefore to initiate a shedding motion from the upper end position into the lower end position or from the lower end position into the upper end position, in this exemplary embodiment too the linear motor 12 is put into operation. The sum of the effective forces of the linear motor 12 and the spring force of the leaf spring 14 in the deflected state, that is to say in one of the end positions, is greater than the holding force of the holding means.

When the holding force of the holding means is overcome, the motion of the heddle is brought about for the most part by the spring force of the leaf spring 14, and the linear motor 12 moves along with this motion without significantly contributing to it. When the other end position is reached, the leaf spring 14 remains deflected, since the holding force of the holding means in this position is greater than the restoring force of the leaf spring 14, and the linear motor 12 does not assist the latter.

LIST OF DESIGNATIONS

2 heddle apparatus
$2_1$-$2_6$ group of heddle apparatuses
4 heddle frame
6 heddle support
8 heddle connector
10 support frame
12 linear motor
14 leaf spring
16 leaf spring
18 shedding block
20 spring holder
22 shedding block
24 upper stop magnet
26 lower stop magnet
28 block part
30 upper magnetic counter-holder
32 lower magnetic counter-holder
34 flat coil
36 upper coil magnet
38 lower coil magnet
40 heddles
42 weaving reed
44 reed support
46 electrical conductors
48 connection plate
50 warp threads
100 spring force diagram
102 magnetic force diagram
104 coil force diagram
106 warp thread force diagram
130 upper holding element
132 lower holding element
M center line

The invention claimed is:

1. A shedding apparatus for a weaving machine comprising at least one heddle apparatus and a heddle frame, which is connected to a spring drive and magnetically acting holding means, which are opposed to the driving force of the spring drive and hold the heddle frame in an upper shed position and a lower shed position counter to the spring force, the heddle frame also being connected to a linear motor, by the activation of which a heddle motion is initiated, the sum of the forces of the spring drive and the linear motor overcoming the action of the holding means, wherein the spring drive is formed as a tension/compression spring such that, when the heddle frame is operated at the resonant frequency of the spring drive, the greater part of the kinetic energy for moving the heddle frame is obtained from the spring drive.

2. The shedding apparatus as claimed in claim 1, characterized in that the tension/compression spring is designed such that, when the heddle frame is operated at the resonant frequency of the spring drive, at least 75% of the kinetic energy is obtained from the spring drive.

3. The shedding apparatus as claimed in claim 1, characterized in that the holding means are formed as uncontrolled holding means and comprise two stop magnets which are formed as permanent magnets.

4. The shedding apparatus as claimed in claim 3, characterized in that the holding means also comprise magnetic counter-holders.

5. The shedding apparatus as claimed in claim 1 characterized in that the holding means are formed as uncontrolled holding means and comprise holding magnets and magnetically acting holding elements, the latter being able to enter the effective range of the holding magnets.

6. The shedding apparatus as claimed in claim 5, characterized in that the holding magnets are formed as permanent magnets and the magnetically acting holding elements are formed as iron parts.

7. The shedding apparatus as claimed in claim 5, characterized in that the holding magnets are formed as coil magnets of the linear motor.

8. The shedding apparatus as claimed in claim 1, characterized in that, in a third shed position of the heddle frame, between the upper shed position and the lower shed position, no force is exerted on the heddle frame.

9. The shedding apparatus as claimed in claim 8, characterized in that the third shed position forms a middle shed position of the heddle frame.

10. The shedding apparatus as claimed in claim 1, characterized in that the spring drive is formed as a leaf spring with a driving force in two directions, with a deflection from the rest position of the leaf spring opposed to these directions.

11. The shedding apparatus as claimed in claim 10, characterized in that the leaf spring is formed in a ring-like manner.

12. The shedding apparatus as claimed in claim 1, characterized by a further leaf spring formed in a ring-like manner at the other end of the heddle apparatus.

13. The shedding apparatus as claimed in claim 1, characterized in that the heddle apparatus is formed symmetrically with respect to its center axis.

14. The shedding apparatus as claimed in claim 1, characterized in that it has a number of heddle apparatuses arranged in a group.

15. The shedding apparatus as claimed in claim 14, characterized in that the heddle apparatuses are arranged alternating with one another such that the springs are arranged alternating with one another, one or more on top and one or more underneath.

16. The shedding apparatus as claimed in claim 3, characterized in that the heddle apparatus has a support frame that is connected to the heddle frame and encloses a fixed block part, the stop magnets being arranged on the upper side and underside of the block part and the magnetic counter-holders being arranged on the upper and lower parts of the support frame.

17. The shedding apparatus as claimed in claim 16, characterized in that the block part has an upper part and a lower part, which can be adjusted according to the inclination of the running of the warp threads of the upper shed and the lower shed, respectively.

18. The shedding apparatus as claimed in claim 1, characterized in that the linear motor has a flat coil, which is arranged in the plane of the heddle frame.

19. The shedding apparatus as claimed in claim 2, characterized in that the holding means are formed as uncontrolled holding means and comprise two stop magnets, which are formed as permanent magnets.

20. The shedding apparatus as claimed in claim 2 characterized in that the holding means are formed as uncontrolled holding means and comprise holding magnets and magnetically acting holding elements, the latter being able to enter the effective range of the holding magnets.

* * * * *